United States Patent [19]

Rosman

[11] 4,216,881

[45] Aug. 12, 1980

[54] PROPELLANT STORAGE EXPULSION SYSTEM

[75] Inventor: Irwin E. Rosman, Woodland Hills, Calif.

[73] Assignee: Rockwell International Corporation, El Segundo, Calif.

[21] Appl. No.: 904,691

[22] Filed: May 10, 1978

[51] Int. Cl.[2] ..... B65D 35/22

[52] U.S. Cl. ..... 222/94; 220/85 B; 222/95; 222/183

[58] Field of Search ..... 220/85 B; 138/30; 222/94, 95, 386.5, 389, 180

[56] References Cited

U.S. PATENT DOCUMENTS

| | | | |
|---|---|---|---|
| 2,880,759 | 4/1959 | Wisman | 220/85 B |
| 3,339,803 | 9/1967 | Wayne et al. | 222/389 X |
| 3,656,662 | 4/1972 | Peterson | 222/386.5 |
| 3,722,751 | 3/1973 | Bisciglia | 222/94 |

FOREIGN PATENT DOCUMENTS

| | | | |
|---|---|---|---|
| 998182 | 7/1965 | United Kingdom | 222/95 |

*Primary Examiner*—David A. Scherbel

*Attorney, Agent, or Firm*—L. Lee Humphries; Robert M. Sperry

[57] ABSTRACT

A geodesic, oblate spheroidally-shaped tank is disclosed containing a reversible diaphragm disposed within the tank. Liquid propellant is stored in the diaphragm housed within the tank, the propellant being expelled through an exit orifice of the tank by applying pressurant through an inlet orifice of the tank between the inner wall of the tank and the exterior wall of the diaphragm. The oblate spheroidal shape of the diaphragm-/tank combination controls the collapse mode of the diaphragm for uniform expulsion of fluid contained therein.

28 Claims, 21 Drawing Figures

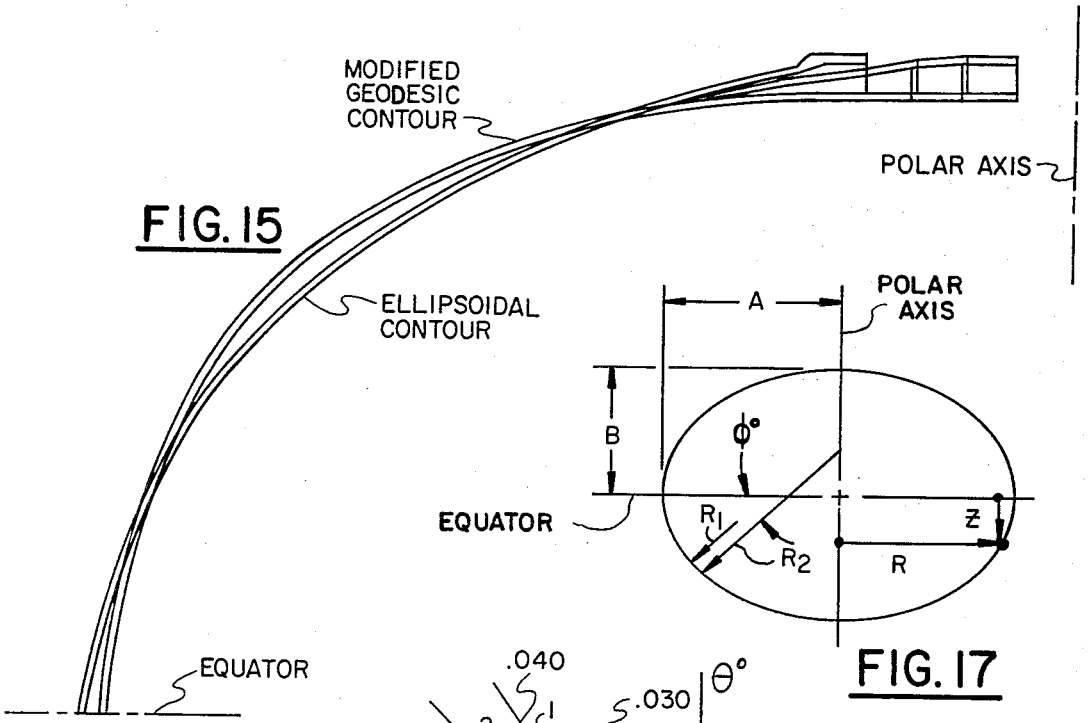
FIG. 15
FIG. 17
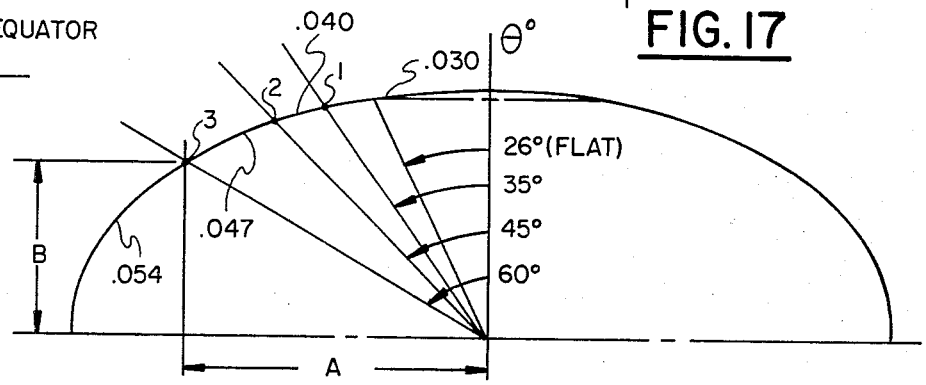
FIG. 18a
FIG. 18b
| % VOLUME | | Z | R | PREDICTED | |
|---|---|---|---|---|---|
| POINT | EXPELLED | | | ΔP ROLL | ΔP BUCKLE |
| 1 | 1.5 | 11.78 | 8.32 | 3.3 | 4.1 |
| 2 | 3.5 | 10.96 | 10.98 | 3.5 | 9.4 |
| 3 | 16.5 | 8.50 | 14.72 | 3.45 | 17.0 |
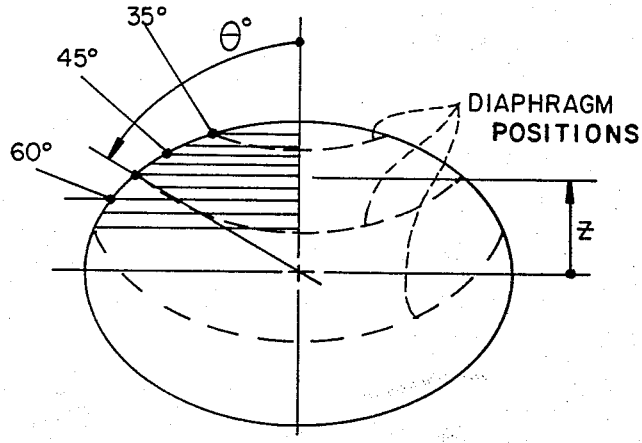
FIG. 19

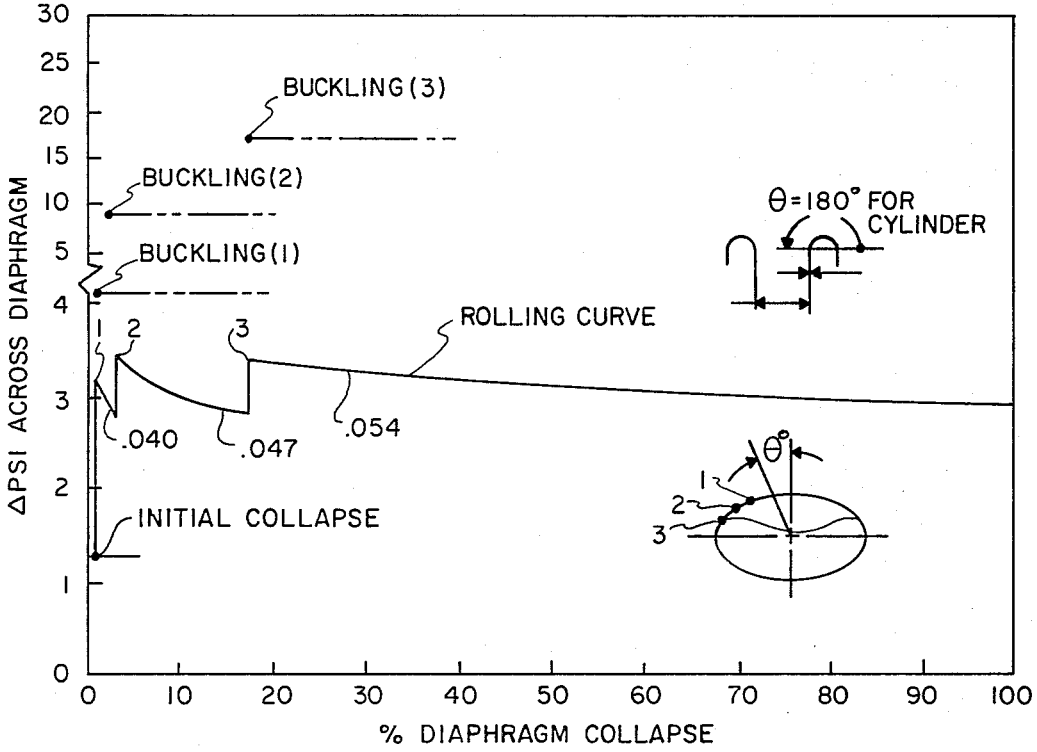
FIG. 20
FIG. 16
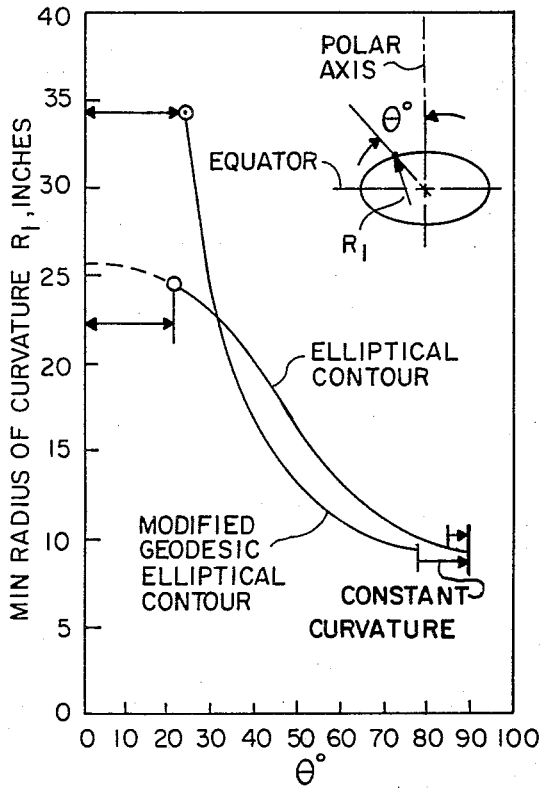

PROPELLANT STORAGE EXPULSION SYSTEM

BACKGROUND OF THE INVENTION

1. Field of the Invention

This invention is related to the field of liquid expulsion devices wherein liquid is expelled out of a tank by a positive expulsion mechanism.

More particularly, this invention is related to a liquid expulsion device wherein a diaphragm or bladder is utilized, the diaphragm containing the liquid is subjected to external pressure, the pressure forcing the diaphragm to expel the fluid out of the tank, the diaphragm eventually conforming to the opposite wall of the tank.

2. Description of the Prior Art

Many companies, particularly those associated with the aerospace industry, have employed collapsible diaphragms in liquid storage expulsion tank systems of various configurations and modes of expulsion. The problem of expelling liquids in the space atmosphere is highly complex. The probability of diaphragm failure is high in state-of-the-art expulsion devices, especially during liquid expulsion when metallic bladders are used. For collapsible metallic diaphragms, the failure mode is cracking of the diaphragms after partial collapse, wherein buckling of the bladder prior to reversing causes seam formation of the excess diaphragm material which must open up again for complete diaphragm reversal. Feasibility is always questionable for metallic bladders and certain tank geometries. As the degree of bladder elasticity increases, such as an elastomeric bladder, the problem is minimized. However, since elastomers are reactive with commonly used aerospace propellants, non-reactive, non-elastomeric materials such as metals must therefore be used. Metallic bladders are particularly important when long-time storage conditions of the propellants are required. The closer a deflecting body approaches symmetry of deflection, the more uniform the stresses in the metallic membranes during deflection, and the higher the capability of diaphragm reversal without failure. The present invention teaches a means to accomplish symmetry of deflection of metallic diaphragms, such means being applicable to non-metallic diaphragms as well.

A number of patents have issued that disclose collapsible bladders to expel liquid within a tank. For example, U.S. Pat. No. 3,339,803 entitled "Fluid Storage and Expulsion System" discloses a spherical tank with an internal diaphragm which conforms to the interior wall of a tank. The collapse of the diaphragm or liner is controlled essentially by the configuration modifications to the basic diaphragm geometry. Devices such as rings attached to the outside of the diaphragm are used to control the collapse of the diaphragm during the expulsion cycle. The invention additionally describes different tank configurations such as the prolate tank (football shape) wherein the diaphragm traverses from one pointed end to the other. The diaphragm must initiate its collapse at the end where the diaphgram is inherently stiff; therefore, it is necessary to so configure the diaphragm to force the diaphragm to reverse during the expulsion cycle. The foregoing configuration control is diametrically opposed to the teachings of the instant invention. The present invention controls the collapse of the diaphragm by its basic geometry, i.e., the oblate spheroid shape wherein the diaphragm need not be specially configured or stiffened to control the collapse of the diaphragm.

U.S. Pat. No. 3,404,813 discloses a tank with a metallic bladder, the outer structural member of the tank being essentially a sphere. Within the tank is a bladder which is adapted to collapse around an internal framework, the framework having curved bars radially extending from a center feeder tube, the bars being 120 degrees apart. Pressure between the interior wall of the sphere and the exterior surface of the bladder causes the bladder to collapse inwardly around the radially extending bars, thereby forcing the liquid into the center pipe and out of the expulsion device.

The above-described invention is disadvantaged in that the rigid support structure positioned within the flexible bladder merely controls the ultimate shape of the expulsion bladder when it has expelled all of the liquid from the interior thereof. There is no control of the collapse of the expulsion bladder during the initial and intermediate stages of the expulsion process. Therefore, the bladder takes on any number of random shapes during the early expulsion cycle, especially when the expulsion bladder is contained within a missile that is subjected to maneuvering acceleration forces. Liquid is oscillated from one side to the other, or skewed, while the missile is subjected to translational or pitching maneuvers along its flight path. A spherical diaphragm has a constant curvature; therefore, the collapse of the bladder is indiscriminate. It can start anywhere, perhaps several places at once.

Similarly, a prolate spheroid (football shape) is circular in a plane perpendicular to its major axis, its axis of rotation, and therefore has the same undesirable characteristics as the sphere in that its curvature is constant so that the diaphragm or bladder collapse can start at any point along its circular periphery. In the plane which depicts the elliptical shape, the curvature decreases at the ends of the major axis and is, therefore, stiffer at the ends. A symmetrical deflection results, the largest deflection and starting point being in the circular plane of the largest circle at the mid-point of the major axis.

The same asymmetric deflection characteristics are also present with cylindrical bladders with partially restrained ends. For example, another prior art invention, U.S. Pat. No. 3,722,751 entitled "Control-Fold Liquid Expulsion Bladder", assigned to the same assignee as the present invention, describes an expulsion bladder which consists of a liquid expulsion tank having two or more liquid-containing lobes circumferentially placed around the interior of a tank. For example, a three-lobe expulsion tank comprises an inner support structure forming three bays, each bay having a concave shape which is symmetrical to the outer tank walls surrounding the support structure. Between the inner wall of the tank and the wall of the support structure are located three metallic bladders that conform to the shape of each lobe of the tank. Each of these bladders is filled with a liquid propellant and the bladders conform to the walls of the central support structure and the inner wall of the outside containing tank. Gas under pressure is admitted to the area between the inner wall of the tank and the outer wall of the bladder so as to cause the bladders to deflect or buckle radially inwardly toward the center of the support structure. In order to control the collapse mode of each of these bladders, when they are subjected to external gas pressure, i.e., where the collapse starts, and how it reverses in a predictable manner, the wall thickness of the bladder is varied. The variable wall thickness assigned to specific areas on the bladder surface is the only mechanism which assures that the bladder collapses uniformly inwardly while expelling the liquid contained therein. However, initial collapse of a bay may start anywhere along the length of the bay, thus control of the collapse is somewhat uncertain.

Yet another U.S. Pat. No. 3,504,827, teaches a substantially cylindrical expulsion tank with an inner half metallic bladder connected along a longitudinal center line plane, to the inner surface of the cylinder. The outer wall of the bladder containing fluid is subjected to an outside source of pressurant. Pressure is admitted between the inner wall of the tank and the outer wall of the bladder causing the bladder to collapse toward the opposite inner wall of the tank, thereby expelling the fluid from the tank. This invention is subject to random, asymmetric buckling and bladder folding during tank manipulation as heretofore described with respect to the foregoing prior art patents.

SUMMARY OF THE INVENTION

A propellant storage and expulsion system comprises a tank including an inlet tank half-section containing an inlet orifice and an outlet tank half-section containing an outlet orifice, both half-tank half-sections being structurally joined to form a leak-tight assembly. The assembly is of a geodesic or spheroidal shape. In particular, the assembly pertains to an oblate spheroid, wherein the oblate spheroid may be an oblate ellipsoid or a modified oblate ellipsoid. These shapes are basically derived by rotating an ellipse about its minor axis. The term "geodesic", generally defined as being earth-like, and the term "spheroidal", generally defined as resembling a sphere but not identical to it, are used synonymously here. The oblate spheroid is a spheroid having a flattened curvature at the poles. The oblate spheroid tank has an axis of rotation which is its minor axis, any section taken perpendicular to its minor axis being circular. The maximum diameter is at the equator, being midway between the poles, the poles located at each end of the minor axis. It has an inlet orifice located at one pole and an exit orifice located at the opposite pole of the minor axis. In the preferred embodiment, a diaphragm is peripherally joined in a leak-tight manner to the exit tank half in the vicinity of the equatorial plane. The outer surface of the diaphragm wall is substantially in abutment with the like ellipsoidal surface of the inner wall of the inlet tank half, the wall of the diaphragm is so disposed as to deflect inwardly in a direction generally along the minor axis and toward the exit orifice when pressurized by gas entering the inlet orifice. Stored fluid within the tank is located between the walls of the diaphragm and the outlet tank half. The fluid is compressed upon diaphragm collapse, and caused to flow through the outlet orifice during the expulsion cycle.

The characteristics of an oblate spheroid are as follows: The axis of revolution is the polar axis which is the same as the minor axis of an ellipse. The equator lies midway through the ellipse on a plane which is perpendicular to the polar or minor axis of the ellipse. Any section, then, taken parallel to the equator is a perfect circle. The inlets and the outlets of the oblate spheroid are positioned at opposite poles along the minor axis. The normally metallic expulsion diaphragm, for example, would be positioned within one-half of the oblate spheroid tank. The diaphragm would be adjacent to the inlet wherein pressurized gas is admitted to collapse the diaphragm towards the opposite half-shell of the oblate spheroid. Collapse, then, would start in the region of the inlet of the pressurizing gas which is at the point of largest diaphragm curvature and the diaphragm would deflect in circles parallel to the equator. The circle, then, would get progressively larger as it departs or "peels" from the tank wall. The curvature of the oblate spheroid shape decreases incrementally from the pole. The collapsed diameter is concentric and proceeds in increasingly larger circles until it passes through the equatorial plane. To enhance the collapse control, the diaphragm thickness, for example, can be tapered or stepped down from the equator to the pole, although sufficient stiffness resulting from the basic geometry possesses substantial insensitivity to inertia loads and impulse loads which may cause adverse diaphragm deflection. In an alternate embodiment, the bladder could entirely encompass the interior of the oblate spheroid tank, and it would still perform as the half-bladder heretofore described.

The oblate spheroid then approaches the characteristic wherein the closer a deflecting body approaches axi-symmetric deflection, the more uniform the stresses in the membrane.

The object of the present invention is to incorporate a particular tank geometry in combination with a substantially axi-symmetrically reversing diaphragm to provide a uniformly stressed, stable collapse mode which is predictable and repeatable in nature and which assures collapse without failure.

More specifically, it is an object of this invention to provide an oblate spheroid expulsion system wherein a metallic diaphragm is caused to expel fluid contained therein in a manner to control the collapse and to insure that no adverse buckling or seams are formed during the collapsing mode of operation.

Another object is to minimize or preclude change in the center of gravity from the polar axis of the fluid remaining in the tank during the expulsion cycle.

It is yet another object to provide a light-weight thin wall tank and diaphragm system.

Another object is to reduce the number of components in an expulsion system.

It is yet another object to provide a reliable tank diaphragm sealing and joining means.

It is still another object to provide propellant exit means to a single exit orifice without entrapment of the propellants contained within the bladder.

It is yet another object to provide means for varying the tank volume capacity for a given basic tank geometry.

The teachings of the present invention provide an advantage over the prior art in that the collapsing mode of operation insures that random buckling, beam formation caused by excess diaphragm material, and diaphragm rupture during the reversal mode are substantially eliminated as the diaphragm expels fluid from the interior thereof.

The above-noted objects and advantages of the present invention will be more fully understood upon a study of the following detailed description in conjunction with the detailed drawings.

DESCRIPTION OF THE DRAWINGS

FIG. 15 depicts an elliptical contour superimposed on a geodesic contour which is a modified elliptical contour;

FIG. 16 is a graph illustrating the curvature comparison between the oblate spheroid of elliptical contour shape and the modified elliptical contour;

FIG. 17 illustrates the modified geodesic oblate spheroid contour parameters;

FIG. 18*a* depicts the collapse mode characteristics of the diaphragm or bladder of the preferred embodiment of this invention;

FIG. 18*b* is a table showing the percent volume expelled under diaphragm collapse at points 1, 2 and 3 along the curvature from the pole to the equator.

FIG. 19 diagrammatically illustrates the percent diaphragm volume expulsion for a diaphragm at different collapse positions; and FIG. 20 is a graph illustrating the nominal diaphragm collapse mode of the stepped diaphragm.

DESCRIPTION OF THE PREFERRED EMBODIMENTS

Figure 1:
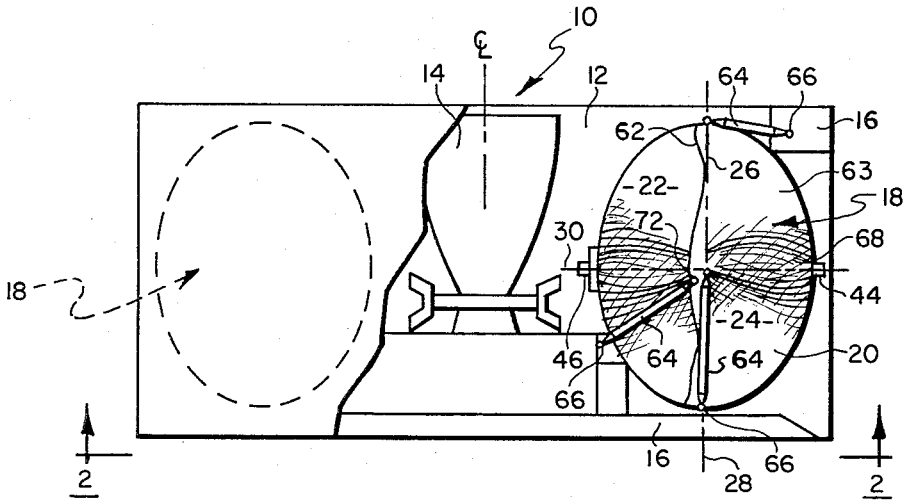
FIG. 1 is a partially cut-away section of a propulsion assembly illustrating the oblate spheroid tank and its relationship to the propulsion unit.
Figure 4:
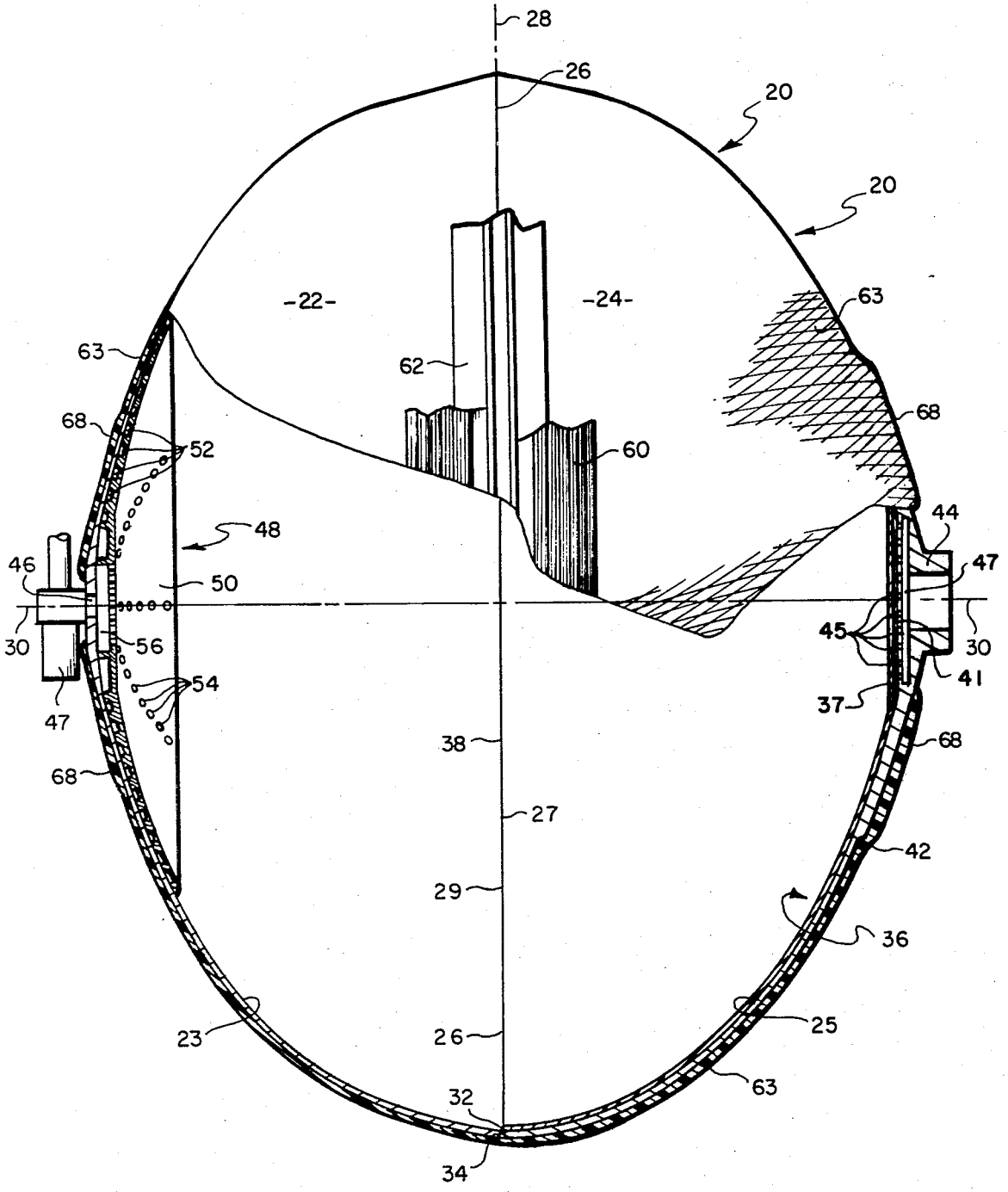
FIG. 4 is a partially broken-away view of the oblate spheroid tank illustrating the internal diaphragm and other mechanisms.

Turning now to FIG. 1, the propulsion assembly generally designated as 10 is comprised of an outer housing 12, a central propulsion engine 14, and at least a pair of oblate spheroid tanks generally designated as 18. The tanks are positioned on either side of the central propulsion engine and the tanks are supported by a bulkhead or frame member 16 by a series of tank struts 64 connected between a tank supporting attach ring 62 attached to the equator of each of the tanks. The tanks 18 are designed to expel fluid axially inwardly towards the central engine 14, each tank expelling the fluid simultaneously, thereby preventing an out-of-balance condition of the missile or launch vehicle. The propellant tanks 18 consist of an inboard half-section 22 closest to the central engine 14 and an outboard half-section 24. The two tank halves are joined along the equatorial plane 26, the details of which are illustrated in FIG. 4. A diaphragm or bladder 36 is positioned within the tank (FIG. 4) that expels fluid out of propellant outlet 46 and a gas pressurant is admitted between the interior face of the tank shell 20 and the exterior face of the bladder 42 to force the diaphragm radially inward thereby expelling fluid out of the propellant outlet conduit 46. The diaphragm 36 then travels along the minor axis 30 of the oblate spheroid tank 18. The diaphragm is secured along the equator between the two tank halves 22 and 24, more clearly shown in FIG. 4. The opposite tank 18 shown in phantom in FIG. 1 operates in an identical manner as the oblate spheroid just described. The two-tank system may be designed, for example, for a bipropellant rocket engine propulsion unit. The spheroidal tanks of the preferred embodiment are reinforced by reinforcing filament material 63, which is a filament winding that is spun on to the tank shell halves after they are joined, thereby resisting the internal pressure exerted against the walls of the oblate spheroid tank 18. The filament winding builds up in the pole area 68 adding strength along the pole axis to resist internal pressure that tends to push the poles apart. A tank support attach ring 62 is placed around the equator 26 of the oblate spheroid tank to accommodate a means to attach the various struts 64 between the attach ring 62 and the surrounding structure 16. A separate filament winding 60 overlaps the attach ring around the equator 26 to add support through the major axis 28 and to secure the attach ring 62 to the equator 26.

Figure 2:
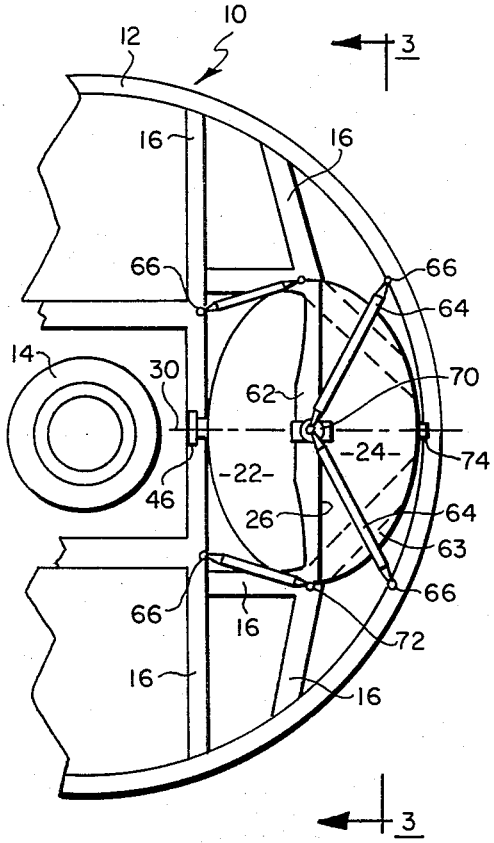
FIG. 2 is a view taken along lines 2—2 of FIG. 1 illustrating further the relationship of the oblate spheroid tank with the other components of the propulsion section.

Turning now to FIG. 2, this view clearly shows the way in which the oblate spheroid tank is attached to the surrounding structure. As the gas pressurant is admitted through tank pressure inlet 44, the diaphragm is caused to move along the minor axis 30 expelling the fluid out through outlet conduit 46. The tank positioned on the opposite side is operating simultaneously, thus assuring that the fluid weight distribution is equal around the circumference of the missile so as not to disturb any center of gravity parameters important to the flight stability of the vehicle.

Figure 3:
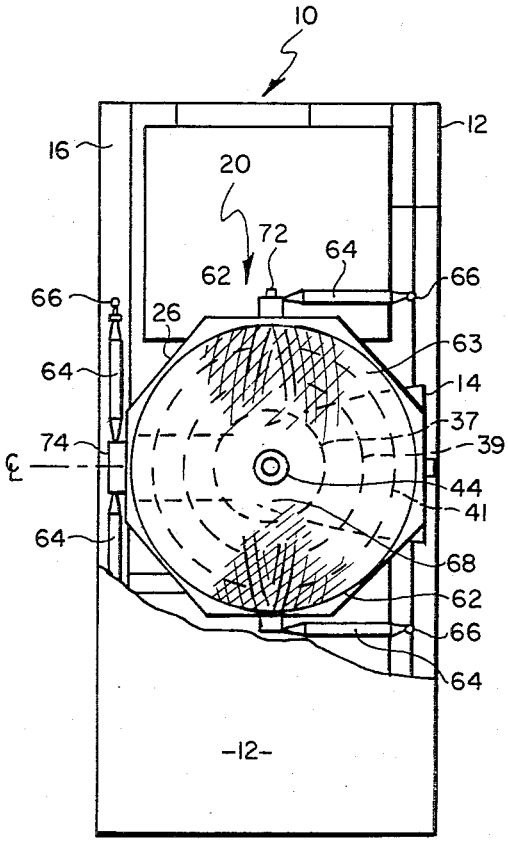
FIG. 3 is a view taken along lines 3—3 of FIG. 2 further illustrating the view of the oblate spheroid showing the circular cross-section taken through a plane parallel with the equator of the tank.

FIG. 3, the oblate spheroid tank 18 is viewed in a direction along the minor axis 30 illustrating the circular configuration of the tank. Thus, it is obvious in an expulsion cycle that the internal diaphragm, as it collapses towards the opposite wall 23 (FIG. 4) in tank half 22, the collapse of the diaphragm progresses from a small circle 37 to consecutively larger concentric rings 39 and 41 as the diaphragm peels away from the interior face 25 (FIG. 4) of the outer shell 24 towards the inner face 23 of shell 22. In this way, undesirable folding of the internal diaphragm during collapse of the diaphragm is precluded due to the unique configuration of the oblate or geodesic spheroid tank of this invention.

Figure 6:
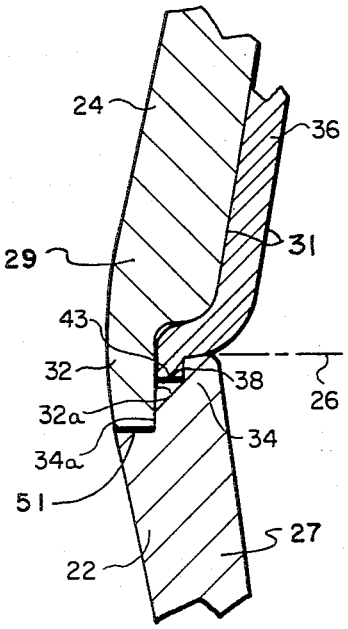
FIG. 6 is a partial view of the two half-segments of the tank illustrating the means by which the diaphragm is retained along the equator where the two tank halves join.

Turning now to FIG. 4, the tank shell 20 is fabricated from a material such as 5086 aluminum that makes up the shell halves 22 and 24. Within the outboard half-shell 24 is positioned, for example, a metallic diaphragm generally designated as 36 and fabricated from, for example, annealed, pure aluminum 1100-0 material manufactured by, for example, Alcoa. The exterior surface of wall 42 of diaphragm 36 mates with the inner surface of wall 25 of the outboard tank shell half 24. The diaphragm is attached within the oblate spheroid tank 18 along the equatorial plane 26. End 27 (FIG. 6) of inboard tank half 22 mates with end 29 of outboard tank half 24. A lip 32 is formed in the end 29 of outboard tank shell 24. An interfitting lip 34 is formed in end 27 of tank shell 22 and the end 38 of the diaphragm is mated with lip 34 and metallurgically bonded to lip 34 at joint 43, thereby attaching the peripheral end 38 of diaphragm 36 within the spheroid tank 18 (FIG. 6). Obviously, the peripheral end 38 could be bolted between the tank halves for reasons of replaceability. The tank pressure inlet 44 (FIG. 4) directs fluid (a gas such as helium) through a diffuser plate 41. The tank shell half 24 surrounding the inlet 44 and plate 41 form a chamber 47 for the entering fluid. A multiplicity of orifices 45 is plate 41 evenly distribute the pressurizing gas along section 37 of diaphragm 36, thereby starting the collapse mode of the diaphragm.

Figure 5:
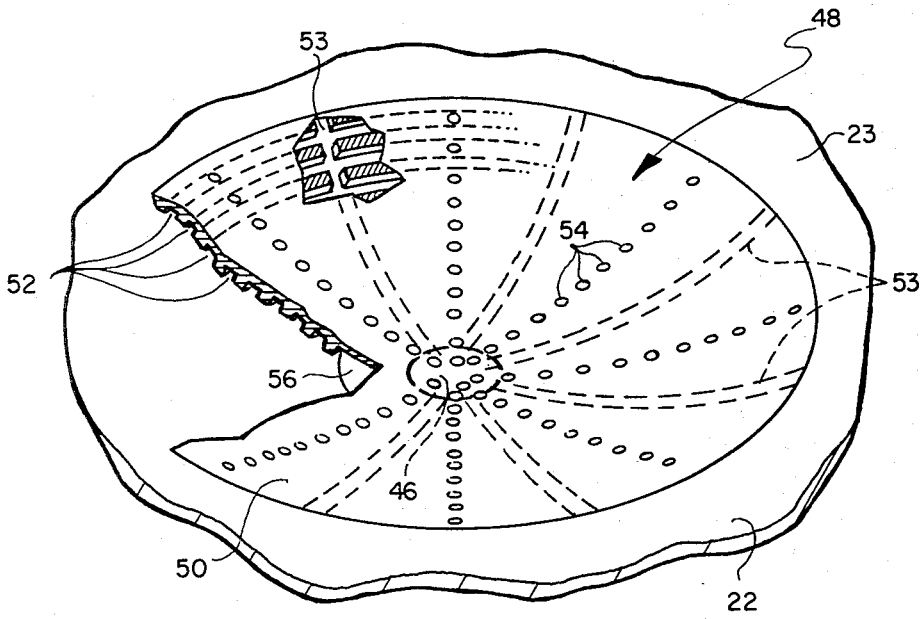
FIG. 5 is a partially broken-away perspective view of a segment of the tank which expels the fluid out of the tank.

The perspective view illustrated in FIG. 5 depicts an outlet fluid receptacle disc-like structure designated as 48. The structure 48 serves to direct fluid out of half-shell 22 through exit 46 (FIG. 4). The structure 48 forms a circular disc 50 having a series of concentric fluid passages or channels 52 under the disc. Spoked channels 53 intersect each concentric fluid passage to direct fluid into chamber 56 and out exit 46. The passages 52–53 provide additional fluid exit means to exit 46 in the event that the diaphragm closes over the exit orifices 54 located immediately over the exit 46 during the last stages of fluid expulsion out of oblate spheroid tank 18. The disc 50 extends outwardly from the exit 46 far enough to assure that no fluid will be trapped during the last states of fluid expulsion. Fluid is directed through orifices 54 into the channels 52–53 between the bottom of the disc and the inside surface 23 of half-shell 22 towards the exit 46. An enlarged plenum 56 is formed between the disc structure 48 and the inside surface 23 of half-shell 22 to facilitate exit of the fluid out of the tank 18 through outlet 46.

Figure 7:
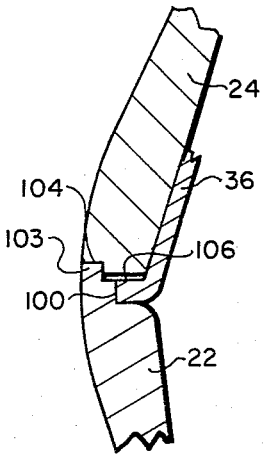
FIG. 7 is a partial view of another embodiment illustrating the means by which the diaphragm is retained along the equator.

Turning to FIG. 6, the enlarged view illustrates the means by which the diaphragm 36 is attached at the equator 26 by trapping the edge 38 of diaphragm 36 between half-shell 22 and half-shell 24. As heretofore mentioned, half-shell 24 has a lip 32 formed in the shell 24 near the equatorial line 26. Shell 22 has a surface **34*a* of interfitting lip 34 which mates within surface 32*a* of lip 32 of half-shell 24. A lip 38 of diaphragm 36 is trapped between lip 34 of shell 22 and the lip 32 of shell 24. Edge 38 of diaphragm 36 is bonded to half-shell 22 at juncture 43, thereby firmly bonding edge 38 to shell 22. A secondary bond is formed at 51 by metallurgically fusing the half-shells 22 and 24 together, forming the oblate spheroid tank shell assembly. The secondary bond or weld assures a complete seal between the two half-shells 22 and 24. In other words, bond 51 forms a backup seal or redundant seal to bond 43 in order to assure non-leakage of fluid from inside the diaphragm to the tank exterior at the equator. An alternative embodiment is illustrated in FIG. 7 wherein diaphragm 36 is bonded to shell 22 at joint 100. Shell 24 is subsequently inserted within lip 103 of shell 22 and is metallurigically bonded to shell 22 at joint 104. A close clearance gap 106 is maintained between shell 24 and diaphragm 36** to insure a close fit in order to minimize diaphragm deflection.

While the diaphragm is preferably joined near the equator 26, it would be obvious to utilize a diaphragm which encompasses the entire inside surface of half-shells 22 and 24, but fixed to the exit half-shell. In other words, the diaphragm may be a full oblate spheroid bladder rather than a half-oblate spheroid diaphragm as illustrated in the drawings. The bladder will still collapse in the manner heretofore described whether it be a full configuration within the spheroid tank 18 or a diaphragm 36 as illustrated and described. The diaphragm and tank curvature portions 31 can be constant, that is, conical near the equator as indicated in FIG. 6 and depicted graphically in FIG. 16.

Figure 8:
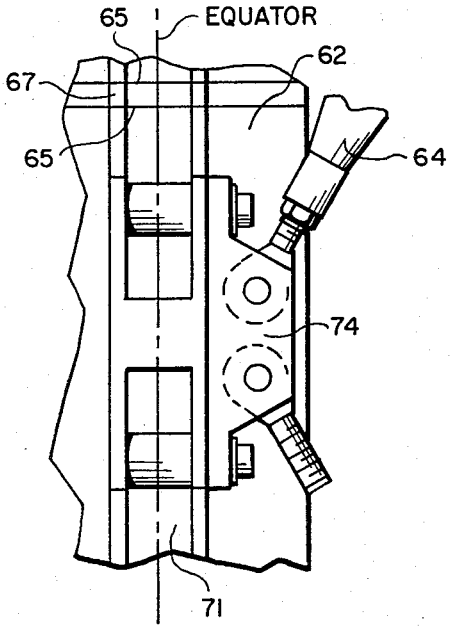
FIG. 8 is a broken-away view of the tank support attach ring positioned around the equator, the ring providing support for the tank mounting struts illustrated in FIG. 1.
Figure 9:
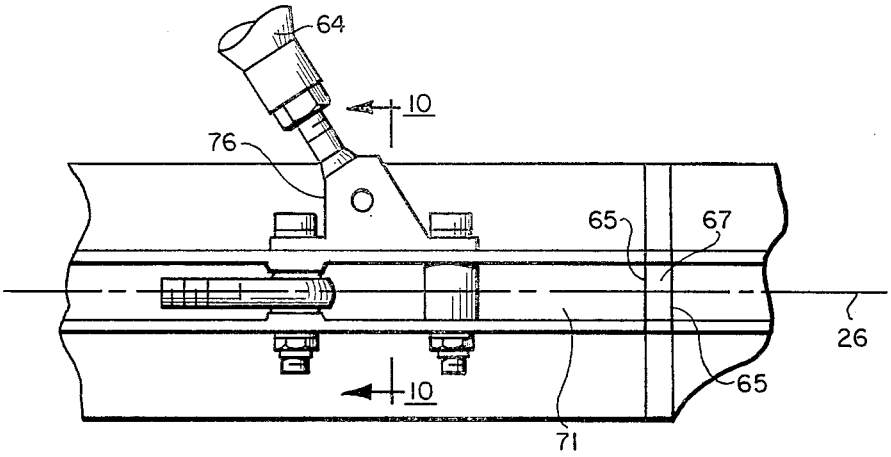
FIG. 9 is a partially broken-away segment of some of the support attachments mounted on the equatorial support ring.
Figure 10:
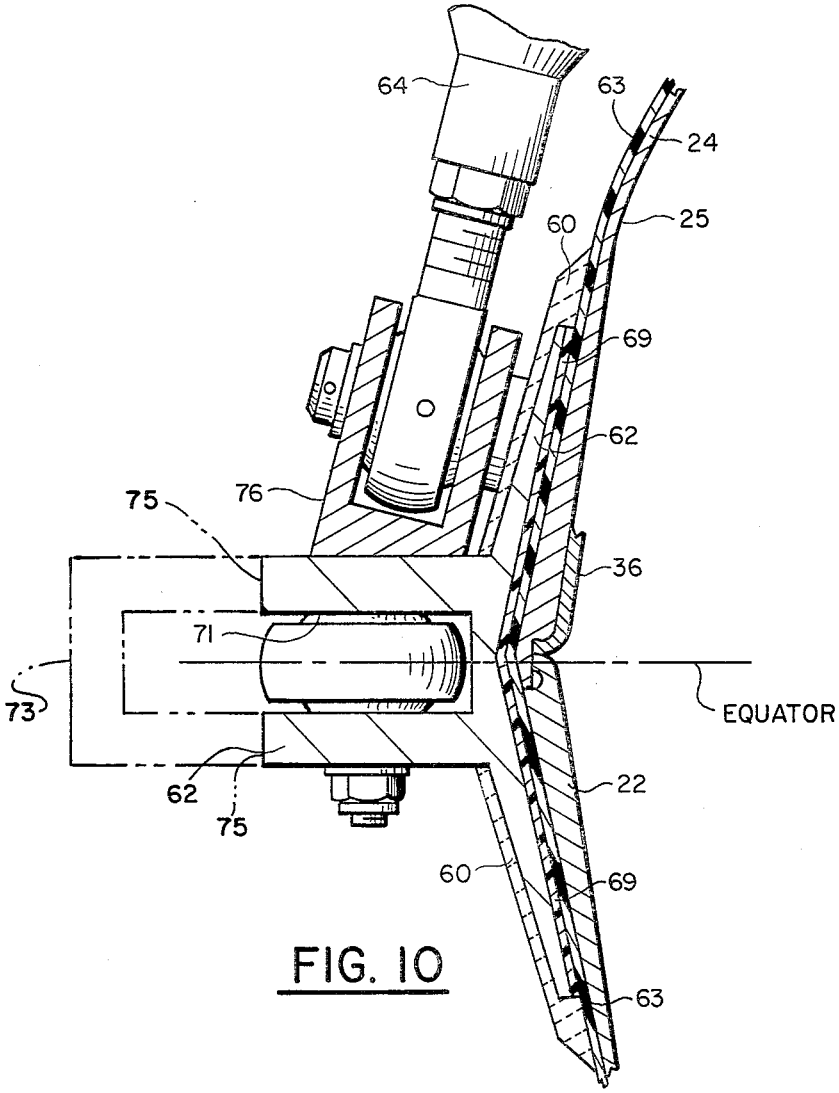
FIG. 10 is a partially broken-away segment of still another support bracket attached to the tank support ring.

Turning now to FIGS. 8, 9 and 10. With reference to FIGS. 1 through 3, the tanks 18 as illustrated in FIG. 1 are secured to a missile structure by a series of strut members 64. Tank 18, after it has been metallurgically bonded as shown in FIGS. 6 and 7, is surrounded and reinforced at the equator by a tank support attach ring 62. Ring 62 is a circumferential girth ring that serves to provide an anchor for a series of attach fittings for the struts 64. It has one or more splits 65 to permit assembly around the firth of the tank with the proper fit such as a belt, and a spacer 67 is placed within the split gap to control the fit. For example, in FIG. 8 the equatorial support ring 62 forms a means to mount a strut support block 74 to channel 71 of ring 62. FIGS. 9 and 10 illustrate similar strut support fittings 76 anchored to the support ring 62. Ring 62 provides a strut anchor positioned strategically around the ring to provide proper support for tanks 18. Strut support block 76 in FIGS. 9 and 10 is angled to facilitate the strut 64 which is attached to support structure 16 of the housing 12 of the vehicle shown in FIGS. 1, 2 and 3. A cross-section of the ring 62 is clearly shown in FIG. 10. It will be noted in FIG. 10 that the ring 62 is further supported by circumferential filament windings 60 that are wound over the equatorial ring 62 around the equator to provide a means to attach the ring to the joined tank halves 22 and 24, and also to provide additional strength in a directional parallel to the minor axis of the oblate spheroid tank. Additonally, ring 62 is nested over an elastomeric band 69 that provides a resilient barrier to shock from the struts 64 mounted to the frame 16 (FIG. 1). A cap ring 73 may be metallurgically bonded to ring 62 to further reinforce the attach support ring 62.

Referring to FIG. 4, a separate filament winding 63 is first polar wound around the complete tank. This winding is made of, for example, an extremely high-strength composite such as Kevlar 49 fiber, a DuPont material having at least a tensile fiber strength of 300,000 psi, and epoxy resin to resist the internal fluid pressure and control the deflection of the tank.

Figure 11:
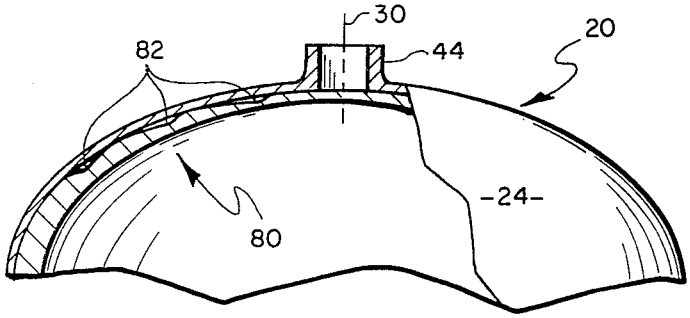
FIG. 11 is a partially broken-away views of the oblate spheroid tank illustrating an alternative embodiment of the diaphragm.

FIG. 11 illustrates a preferred embodiment of the oblate spheroid tank wherein the diaphragm generally designated as 80 is configured in varying thickness layers 82 by, for example, chemical milling the metallic diaphragm 80 to provide a thin section near the pole adjacent pressure inlet 44 and progressively thickening the diaphragm as it approaches the equator of tank 18. This configuration provides additional assurance that the diaphragm will not buckle near the equator prior to rolling of the diaphragm away from the tank wall, the rolling mode being the principal mode of collapse. The stepped thicknesses also assist the collapse mode in maintaining a collapse mode parallel with the equator;

providing additional assurance of a uniform collapse of diaphragm 80. It should be pointed out, however, that the diaphragm need not be stepped—the oblate spheroid configuration will force the diaphragm to collapse through the equator in ever-widening concentric rings as illustrated in FIG. 4.

Figure 12:
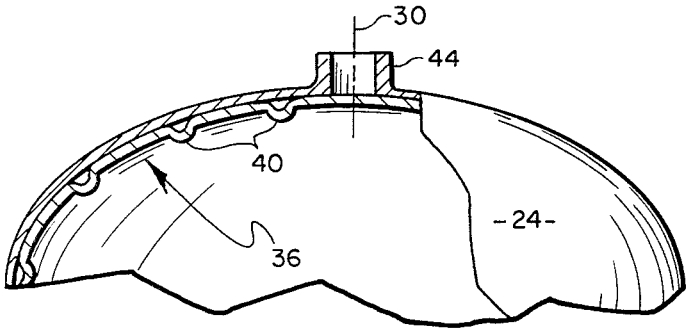
FIG. 12 is a partially broken-away view of the tank illustrating still another embodiment of the diaphragm.

FIG. 12 illustrates an alternative embodiment wherein there are a series of concentric ring indentations or channels 40 within diaphragm 36; the rings also provide a means to control the collapse of the diaphragm in ever-widening concentric rings parallel with the equator, thus additionally assuring uniform collapse of the diaphragm 36 against the opposite tank shell 22 (not shown).

Figure 13:
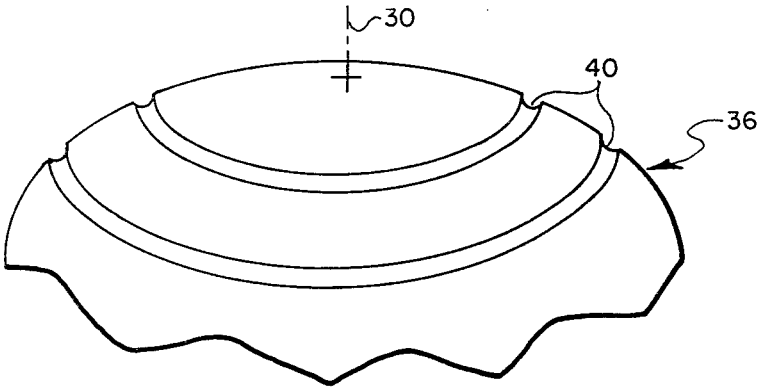
FIG. 13 is a partially broken-away perspective view of the diaphragm configuration shown in FIG. 12.

FIG. 13 is a partial perspective view of diaphragm 36 as shown in FIG. 12 illustrating the concentric rings formed in the diaphragm 36.

Figure 14:
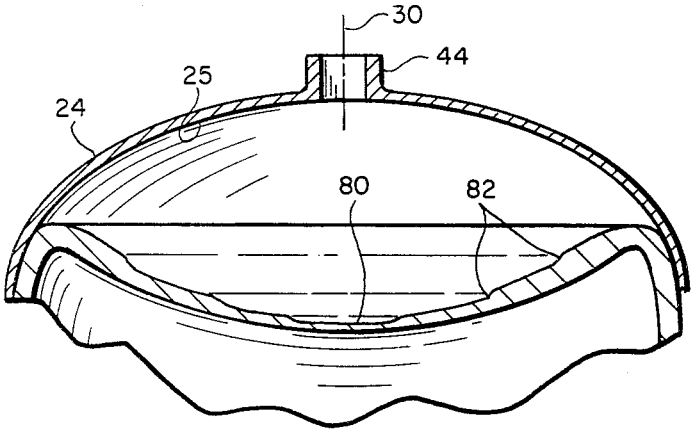
FIG. 14 is a partial section of the tank illustrating the diaphragm in a partially collapsed mode.

FIG. 14 illustrates diaphragm 80 during an expulsion cycle wherein the diaphragm 80 rolls inward from the interior surface 25 of tank half-shell 24 in an ever-widening concentric circular pattern as the diaphragm approaches the equator during the expulsion cycle. Steps 82 additionally assure that the diaphragm 80 rolls uniformly from surface 25 of shell 24. The diaphragm 80 will finally collapse against the disc structure generally designated as 48 (FIG. 5), thus expelling substantially all of the fluid through the disc into the exit 46.

It should be noted here that the exterior shape of the tank 18 need not be a perfect ellipsoidal oblate spheroid shape; rather, the contour may be a modified ellipsoid, provided that the radius of curvature at any point on the contour decreases in the direction from the pole to the equator. By providing a curvature that is relatively flat at the pole and relatively sharp at the equator, the diaphragm or bladder must then collapse into the opposite tank half-shell in a series of concentric ever-widening rings from the pole nearest the pressure inlet towards the equator. Thus, it can be seen that the shape could almost approach a sphere as long as the length of the minor axis, as measured from the pole to the equatorial plane, is shorter that the equatorial diameter. The preferred A/B ratio where A equals the radius of the equator, and B equals the distance between the equator and one of the poles, is approximately 1.4 and within the range from 1.2 to 1.9.

Turning now to FIG. 15, a pair of contours are illustrated. One contour defines the shape of a quadrant of the ellipsoidal oblate spheroid tank between the polar axis and equator, and the other curve defines a modified geodesic contour which is especially suited for filament wound tanks. The modified ellipsodal or geodesic shape as defined in FIG. 15 is the optimum shape for a filament wound tank. This optimum shape assures that the resultant stress in the direction of the fibers of the filament wrap is substantially constant and within the allowable strength of the composite wrap. The stresses in the hoop and meridianal directions at any point along the wrap of the geodesic tank are the principal component stresses which define the resultant fiber stress in the direction of the fiber.

The graph shown in FIG. 16 will clarify the differences in the radii of curvature between an ellipsoidal tank shape versus the modified ellipsoidal tank. The modified ellipsoidal curve in the vicinity of the pole has a larger radius of curvature, i.e. approximately 35 inches, than the radius of curvature of the ellipsoidal curve which is approximately 25 inches. The ellipsoidal curve shows a rate of slope which is different from that of the modified ellipsoid, but nevertheless both show a decreasing curvature as the contour approaches the equator. The modified ellipsoid shows a rate of change of slope which is more optimum for a filament wound tank.

FIG. 17 schematically shows a modified geodesic oblate spheroid having coordinates defined in the following table. For example, in a tank where A=18.307 inches, B=12.810 inches, and the A/B ratio 1.42, these coordinates apply.

| | Inside Liner | | Composite Thickness | | | |
|---|---|---|---|---|---|---|
| | R | Z | | $R_1$ | $R_2$ | 0° |
| 1 | 18.307 | 0.000 | .0320 | | | 12.000 |
| 2 | 17.563 | 3.500 | .0334 | | | 12.000 |
| 3 | 17.398 | 4.156 | .0337 | 9.235 | 18.162 | 16.284 |
| 4 | 17.182 | 4.808 | .0342 | 9.392 | 18.391 | 20.519 |
| 5 | 16.919 | 5.441 | .0347 | 9.539 | 18.654 | 24.692 |
| 6 | 16.611 | 6.054 | .0354 | 9.716 | 18.984 | 28.792 |
| 7 | 16.261 | 6.643 | .0362 | 9.926 | 19.374 | 32.807 |
| 8 | 15.872 | 7.205 | .0371 | 10.171 | 19.927 | 36.726 |
| 9 | 15.446 | 7.739 | .0382 | 10.454 | 20.346 | 40.540 |
| 10 | 14.986 | 8.243 | .0395 | 10.776 | 20.936 | 44.240 |
| 11 | 14.496 | 8.716 | .0409 | 11.143 | 21.602 | 47.816 |
| 12 | 13.979 | 9.157 | .0425 | 11.558 | 22.350 | 51.262 |
| 13 | 13.438 | 9.566 | .0443 | 12.028 | 23.188 | 54.570 |
| 14 | 12.876 | 9.943 | .0464 | 12.558 | 24.123 | 57.735 |
| 15 | 12.297 | 10.287 | .0488 | 13.156 | 25.164 | 60.749 |
| 16 | 11.703 | 10.600 | .0515 | 13.834 | 26.323 | 63.609 |
| 17 | 11.097 | 10.882 | .0546 | 14.602 | 27.609 | 66.310 |
| 18 | 10.483 | 11.134 | .0582 | 15.478 | 29.035 | 68.848 |
| 19 | 9.863 | 11.357 | .0623 | 16.480 | 30.614 | 71.220 |
| 20 | 9.240 | 11.554 | .0672 | 17.636 | 32.355 | 73.421 |
| 21 | 8.617 | 11.725 | .0730 | 18.983 | 34.265 | 75.449 |
| 22 | 7.997 | 11.872 | .0800 | 20.573 | 36.340 | 77.301 |
| 23 | 7.384 | 11.997 | .0833 | 22.488 | 38.560 | 78.971 |
| 24 | 6.782 | 12.101 | .0988 | 24.869 | 40.865 | 80.455 |
| 25 | 6.196 | 12.186 | .1122 | 27.999 | 43.1 | 81.745 |
| 26 | 5.633 | 12.254 | .1298 | 32.566 | 45.114 | 82.825 |
| 27 | 5.390 | 12.278 | .1414 | 35.552 | 45.805 | 84.403 |
| 28 | 4.912 | 12.326 | .1693 | | | 84.403 |
| 29 | 4.434 | 12.373 | .2190 | | | 84.403 |
| 30 | 3.956 | 12.421 | .4110 | | | 84.403 |
| 31 | 3.478 | 12.468 | .3638 | | | 84.403 |
| 32 | 3.000 | 12.516 | .3855 | | | 84.403 |
| 33 | 0.000 | 12.810 | | | | |

FIG. 18 illustrates the thickness of the diaphragm between the step points 1, 2, and 3 along the curvature from the pole to the equator. The table also indicates the percent volume expelled under diaphragm collapse at these points and the pressure difference across the diaphragm to roll (preferable mode) or buckle. For example, if the diaphragm collapses to point 3, it would have rolled through the thicknesses of 0.030, 0.040, and 0.047. The volume expelled at point 3 is 16.5% of the total tank fluid volume. Also at point 3, it would take 3.45 psi to continue to roll, but would not buckle because 17.0 Δpsi would then be required.

FIG. 19 schematically shows the shape of the diaphragm in the collapse mode at specific points.

The graph shown in FIG. 20 depicts the diaphragm nominal collapse mode for a stepped diaphragm wherein the diaphragm is thinnest at the polar region and progessively thickens at steps 1, 2, and 3 as the diaphragm approaches the equator, as previously indicated in FIG. 18. The diaphragm nominal collapse mode is defined by the discontinuous curve of ΔPSI vs percent diaphragm collapse. Referring to the curve, and also to summary table FIG. 18, initial collapse occurs at about 1.3 ΔP at point 0, where dishing of the flat area occurs. Rolling at point 1 starts at 3.3 ΔP (t=0.040); buckling does not occur since 4.1 ΔP is required. As the rolling continues to point 2, the increased thickness (0.047) starts the rolling at 3.5 ΔP (buckling ΔP=9.4). Rolling continues to point 3. The pressure drops along the rolling curves because the diameter is increasing. At point 3 the ΔP is 3.45 (the larger diameter compensates for the increased thickness of 0.054); however, the buckling ΔP rises to 17.0 because of the thickness and decreased curvature. The diaphragm continues to roll to the equator where reversal is complete.

It will, of course, be realized that various modifications can be made in the design and operation of the present invention without departing from the spirit thereof. Thus, while the principal, preferred construction, and mode of operation of the invention have been explained, and what is now considered to represent the best embodiment has been illustrated and described, it should be understood that within the scope of the appended claims the invention may be practiced otherwise than as specifically illustrated and described.

I claim:

1. In a fluid expulsion tank apparatus wherein fluid pressure is exerted between the interior wall of said tank and an exterior wall of a collapsible liner within said tank to expel fluid from said tank contained within said liner, the improvement which comprises:

a tank formed in an oblate spheroid shape, said tank having a polar axis defining first and second poles, and an equator perpendicular to said polar axis located midway between said first and second poles wherein the radius of said equator is greater than the distance between the equatorial planeand one pole, said tank having a decreasing radius of curvature from said pole to said equator, a collapsible liner conforming substantially to the shape of said tank, an inlet orifice formed by said tank located near said first pole of sand tank, an exit orifice formed by said tank located near said second pole of said tank, fluid contained within said liner, the fluid being expelled from said liner when the liner is subjected to said fluid pressure exerted between the interior wall of the tank and the exterior wall of said liner, the predetermined curvature of the liner controls the collapse of said liner from said first pole of the tank along the polar axis towards the opposite second pole in ever-widening concentric circles substantially parallel to the plane of the equator, said liner collapses in a rolling collapse mode such that random buckling is precluded, initial collapse of the liner commences in the area of said first pole, the liner substantially reverses upon itself as the fluid is expelled through said exit orifice.

2. The invention as set forth in claim 1 wherein said tank comprises a first and second tank half joined at said equator, said first tank half forming said first pole, said second tank half forming said second pole.

3. The invention as set forth in claim 1 further comprising a support attach ring surrounding and attached to said tank, positioned substantially at said equator, said ring providing means to support said tank when subjected to external support loads, said ring having sufficient stiffness to isolate said loads from said tank.

4. The invention as set forth in claim 3 wherein said ring has at least one split to permit assembly of said ring around said tank.

5. The invention as set forth in claim 4 wherein a spacer is contained between said split to control the diametrical fit of said ring to said tank.

6. The invention as set forth in claim 5 wherein said ring may be further reinforced be attaching a cap ring to said attach support ring.

7. The invention as set forth in claim 6 wherein said liner is a diaphragm, positioned within said first half of said tank, an edge formed by said diaphragm is attached to said interior wall of said tank substantially near said equator.

8. The invention as set forth in claim 7 wherein said edge of said diaphragm is metallurgically bonded to said tank.

9. The invention as set forth in claim 8 wherein said edge of said diaphragm is bonded to said second tank half.

10. The invention as set forth in claim 9 wherein said edge of said diaphragm is bolted between said first and second tank halves.

11. The invention as set forth in claim 1 wherein said liner shape is an oblate spheroid, said liner being attached to said tank at said second pole surrounding said exit orifice.

12. The invention as set forth in claim 1 wherein said liner is formed from metal.

13. The invention as set forth in claim 12 wherein said metal is aluminum.

14. The invention as set forth in claim 1 wherein the wall of said liner varies in thickness from a relatively thin wall adjacent said first pole to a relatively thick wall adjacent said equator, said variable wall thickness of said liner thereby more effectively controlling the collapse mode of said liner.

15. The invention as set forth in claim 1 in which said thickness is tapered.

16. The invention as set forth in claim 14 in which said thickness is stepped.

17. The invention as set forth in claim 14 wherein said liner is metal, the variable thickness being formed by chemical milling.

18. The invention as set forth in claim 1 wherein the wall of said liner has a series of ring indentations parallel to said equator to provide additional collapse control of said liner.

19. The invention as set forth in claim 1 wherein said tank is polar wound with a high strength composite fiber.

20. The invention as set forth in claim 1 wherein the ratio of said radius of said equator and the distance between the equatorial plane and one pole is within the range from 1.2 to 1.9.

21. The invention as set forth in claim 20 wherein said ratio is 1.4.

22. The invention as set forth in claim 1 wherein said tank is shaped in an oblate ellipsoidal configuration.

23. The invention as set forth in claim 1 wherein said tank is shaped in a modified geodesic configuration.

24. The invention as set forth in claim 1 further comprising a diffuser section formed between said tank and said liner at said first pole, said diffuser section having a wall portion forming a chamber between an outside wall of said tank and said wall portion that communicates with said orifice formed by said tank, a multiplicity of openings formed by said wall portion to uniformly distribute said fluid pressure against said collapsible liner.

25. The invention as set forth in claim 24 wherein said wall portion is flat.

26. The invention as set forth in claim 25 wherein said liner conforms to said flat wall.

27. The invention as set forth in claim 1 further comprising an outlet fluid receptacle in communication with said exit orifice formed by said tank near said second pole, said receptacle forming a fluid collection chamber between said receptacle and said tank, said collection chamber communicates with said fluid contained within said liner through a series of spaced orifices formed by said receptacle that direct said fluid into spoked channels formed by said receptacle toward said exit orifice near said second pole, said receptacle serves to prevent fluid from being trapped between said liner and said tank.

28. The invention as set forth in claim 27 wherein said outlet fluid receptacle is formed in a disc, the outer peripheral edge of said disc extends radially outwardly from said exit orifice formed in said tank.

* * * * *

UNITED STATES PATENT AND TRADEMARK OFFICE

CERTIFICATE OF CORRECTION

PATENT NO. : 4,216,881

DATED : August 12, 1980

INVENTOR(S) : Irwin E. Rosman

It is certified that error appears in the above-identified patent and that said Letters Patent are hereby corrected as shown below:

Column 2, line 39, delete "A symmetrical" and insert --Asymmetrical--.
Column 10, line 15, delete "0°" and insert therefor --$\phi$°--.
Column 12, line 36, delete "Claim 1" and insert therefor --Claim 14--.

Signed and Sealed this

*Sixteenth* Day of *December 1980*

[SEAL]

*Attest:*

SIDNEY A. DIAMOND

*Attesting Officer*

*Commissioner of Patents and Trademarks*